US009474302B2

(12) United States Patent
White

(10) Patent No.: US 9,474,302 B2
(45) Date of Patent: Oct. 25, 2016

(54) CUTTING AND GRINDING APPARATUS, METHOD OF MANUFACTURE OF CUT LENGTHS OF TOBACCO, AND METHOD FOR CONTROLLING THE OPERATION OF A CUTTING APPARATUS

(75) Inventor: Thomas Henry White, Winchester (GB)

(73) Assignee: Dickinson Legg Limited, Hampshire (GB)

( * ) Notice: Subject to any disclaimer, the term of this patent is extended or adjusted under 35 U.S.C. 154(b) by 485 days.

(21) Appl. No.: 13/497,561

(22) PCT Filed: Sep. 27, 2010

(86) PCT No.: PCT/GB2010/051607

§ 371 (c)(1),
(2), (4) Date: Jun. 12, 2012

(87) PCT Pub. No.: WO2011/039529

PCT Pub. Date: Apr. 7, 2011

(65) Prior Publication Data

US 2012/0267458 A1 Oct. 25, 2012

(30) Foreign Application Priority Data

Sep. 29, 2009 (GB) ..... 09170770.0

(51) Int. Cl.
*B02C 18/16* (2006.01)
*A24B 7/12* (2006.01)
(Continued)

(52) U.S. Cl.
CPC ..... *A24B 7/12* (2013.01); *B02C 18/16* (2013.01); *B24B 3/363* (2013.01); *B26D 7/12* (2013.01)

(58) Field of Classification Search
CPC ..... A24B 7/04; A24B 7/14; A24B 7/12; A01F 29/06; B24B 3/363; B24B 3/42; B24B 3/00; B24B 51/00; B26D 7/12; A24C 5/30; B02C 18/16
USPC ..... 241/101.2, 166, 167, 294, 282.1; 83/174, 174.1, 349, 913, 931
See application file for complete search history.

(56) References Cited

U.S. PATENT DOCUMENTS 983,850 A * 2/1911 Whipple ..... 451/421
1,807,975 A * 6/1931 Eyres ..... 83/174.1
2,464,896 A * 3/1949 Schreiber ..... 241/36
(Continued)

FOREIGN PATENT DOCUMENTS

EP 1491102 A1 12/2004
GB 573416 A * 11/1945 ..... A24B 7/12
(Continued)

*Primary Examiner* — Mark Rosenbaum
(74) *Attorney, Agent, or Firm* — The Ollila Law Group LLC

(57) ABSTRACT

A cutting apparatus including a grinder for sharpening knives in the cutting assembly is disclosed. The cutting apparatus includes a mouth for delivering the material to be cut to a cutting position, a cutting drum having at least one knife having a cutting edge, the cutting drum having a drive system and being rotatable about an axis. A grinder is described for removing material from the cutting edge of a knife, the grinder brought into contact with the cutting edge with a movement in a first direction substantially parallel to the axis of rotation of the cutting drum and with a movement in a second direction substantially parallel to the axis of rotation of the cutting drum, the grinder configured to move in the first direction at a first speed and move in the second direction at a second speed, the first speed different to the second speed.

16 Claims, 3 Drawing Sheets

(51) Int. Cl.
*B24B 3/36* (2006.01)
*B26D 7/12* (2006.01)

(56) References Cited

U.S. PATENT DOCUMENTS

| | | | | | |
|---|---|---|---|---|---|
| 2,476,177 | A | * | 7/1949 | Bloom et al. | 83/174.1 |
| 2,690,777 | A | * | 10/1954 | Korber et al. | 241/101.4 |
| 2,738,629 | A | * | 3/1956 | Schreiber | 451/421 |
| 2,763,307 | A | * | 9/1956 | Schreiber | 241/101.2 |
| 2,830,634 | A | * | 4/1958 | Pollmann | 241/101.2 |
| 2,835,299 | A | * | 5/1958 | Pollmann | 83/174 |
| 2,848,030 | A | * | 8/1958 | Rudszinat | 241/101.2 |
| 2,957,508 | A | * | 10/1960 | Mason | 241/33 |
| 3,144,063 | A | * | 8/1964 | Schmermund | 83/174 |
| 3,354,921 | A | * | 11/1967 | Elsner | 241/101.2 |
| 3,374,699 | A | * | 3/1968 | Schmermund | 83/174.1 |
| 3,748,786 | A | * | 7/1973 | Elsner et al. | 451/72 |
| 4,037,712 | A | * | 7/1977 | Wochnowski | 198/524 |
| 4,149,547 | A | * | 4/1979 | Komossa et al. | 131/108 |
| 4,254,781 | A | * | 3/1981 | Thiele et al. | 131/111 |
| 4,401,205 | A | * | 8/1983 | Komossa et al. | 198/524 |
| 4,495,734 | A | * | 1/1985 | Rauch | 451/421 |
| 4,557,074 | A | * | 12/1985 | Elsner et al. | 451/45 |
| 4,632,318 | A | * | 12/1986 | Hyuga | 241/37 |
| 4,635,402 | A | * | 1/1987 | Sakabe et al. | 451/193 |
| 4,640,059 | A | * | 2/1987 | Komossa et al. | 451/72 |
| 5,402,354 | A | * | 3/1995 | Okino et al. | 700/174 |
| 2002/0005098 | A1 | * | 1/2002 | Drenguis | 83/13 |

FOREIGN PATENT DOCUMENTS

| | | | | | |
|---|---|---|---|---|---|
| GB | 573427 | A | * | 11/1945 | A24B 7/12 |
| GB | 694375 | A | | 7/1953 | |
| GB | 774286 | A | | 5/1957 | |
| GB | 1498667 | A | * | 1/1978 | A24B 7/04 |
| GB | 1498668 | A | | 1/1978 | |
| GB | 2143450 | A | | 2/1985 | |
| GB | 2155826 | A | | 10/1985 | |
| WO | WO 2010029348 | A2 | * | 3/2010 | B24B 3/36 |

* cited by examiner

CUTTING AND GRINDING APPARATUS, METHOD OF MANUFACTURE OF CUT LENGTHS OF TOBACCO, AND METHOD FOR CONTROLLING THE OPERATION OF A CUTTING APPARATUS

CROSS-REFERENCE TO RELATED APPLICATIONS

This is a National Stage entry of International Application No. PCT/GB2010/051607, with an international tiling date of Sep. 27, 2010 which claims priority of Great Britain patent application no. 0917077.0, filed Sep. 29, 2009 entitled "Cutting and Grinding Apparatus".

The present invention relates to cutting apparatus and a method of cutting, particularly, but not exclusively, to a cutting apparatus and method of cutting for cutting portions of a laminar product such as tobacco leaves.

Tobacco leaves are processed for cigarette manufacture in a primary tobacco process. Portions of tobacco leaves are compressed together into a laminar product and then cut in a cutting operation using one or more knives. The processing of the tobacco leaves in a cutting machine or apparatus creates tobacco particles suitable for cigarette manufacture. The length of the tobacco strands produced is highly variable, ranging from less than 1 mm to more than 200 mm. The maximum length of particle depends on the sizes of the lamina portions being cut, and these ultimately depend on the dimensions of the leaves from which they came. Other factors that affect the length of the tobacco strands produced include the speed of delivery to, and compression of the tobacco leaves at, the cutting apparatus.

FIGS. 1 and 2 illustrate a conventional tobacco cutting apparatus 10, comprising a vibrating feeder 1, monitor 2 and two converging feed bands 3, 4. Typically each feed band 3, 4 is in the form of a conveyor belt provided with compression weighting whereby the incoming low density tobacco is compressed and conveyed through a mouth 5 towards a cutting drum 6. The feed bands 3, 4 form a jaw assembly of the mouth 5 and together define a plenum through which the tobacco lamina passes and is compressed.

The cutting drum 6 is provided with typically, 8 or 10 knives 12, whereby the knives 12 are arranged perpendicularly to the axis of rotation of the cutting drum 6. The knives 12 are disposed tangentially around the circumference of the cutting drum 6 with a substantially equal circumferential distance between each respective knife 12. Each one of the knives 12 has a cutting edge located opposite the mouth 5.

In operation tobacco leaves are loaded into the feeder 1, conveyed towards the mouth 5 by feed bands 3 and 4. The tobacco product is compressed by the action of the feed bands 3, 4 and is then passed through the mouth 5 towards the cutting drum 6 where it is cut by the action of the knives 12.

Clearly, the cutting process relies on the effective use of the cutting apparatus and the knives. The knives of the cutting apparatus should be sharpened regularly. Upkeep and maintenance of the cutting edge of the knives, for example by sharpening, can impact the overall effectiveness of the cutting apparatus and the quality of the cut surface of the tobacco laminar product.

For this reason, it is known for a cutting apparatus to comprise a grinder such as a grindstone 7, also illustrated in FIG. 1. The grindstone 7 is driven by a motor and configured to be brought into contact with the cutting drum 6 and in particular, the cutting edge portion of the knives 12. In this manner a cutting edge is restored by the removal of material from the knives 12 by grinding. The knives are kept sharp by means of the grinder which traverses back and forth across the width of the cutting drum moving with a uniform speed. Material is removed from a knife by the action of the grindstone 7 in a direction substantially parallel to the cutting drum and in contact with the cutting edge portion of the knives 12.

Conventional grinding techniques, such as those described above have been found to result in uneven grinding with differing amounts of material being removed from different portions of the knives. Excessive sharpening techniques in order to remove excess cutting edge material, are required in order to ensure that an acceptable cutting edge is produced across the dimension of the knife surface, (referred to hereinafter as the knife length or cutting drum width) in a direction parallel to the axis of rotation of the cutting drum.

It is desirable to provide an alternative apparatus for sharpening the cutting edge of a knife of a cutting apparatus which avoids the aforementioned problems.

According to a first aspect, the present invention provides a cutting apparatus comprising, a mouth defined by a jaw assembly for delivering the material to be cut to a cutting position at the mouth; a cutting drum having; at least one knife the, or each, knife having a cutting edge, the cutting drum having drive means therefore and being rotatable about an axis arranged substantially parallel to the mouth such that the cutting edge of the at least one knife is arranged substantially perpendicular to the material to be cut; a grinder for removing material from the cutting edge of the at least one knife the grinder comprising a cylinder having a cylindrical surface comprising a substantially constant radius, the grinder being configured to be rotated about an axis arranged substantially parallel to the axis of rotation of the cutting drum and the grinder being configured to be brought into contact with the cutting edge with a first movement in a first direction substantially parallel to the axis of rotation of the cutting drum and with a second movement in a second direction substantially opposite to the first direction and substantially parallel to the axis of rotation of the cutting drum, wherein the grinder is configured to execute the first movement in the first direction at a substantially uniform first speed and the second movement in the second direction at a substantially uniform second speed, wherein the first speed is different to the second speed.

The knives may undergo testing and assessment to monitor their performance. Monitoring and maintenance can be time consuming. By providing a cutting apparatus with a grinder operating with a combination of speeds in the grinding directions parallel to the axis of rotation of the cutting drum the amount of material ground from the cutting edge can be regulated and excessive removal of material can be avoided. Advantageously, this leads to a reduction in maintenance costs as the knives wear out more slowly, and have to replaced less often.

The grinder may be configured to execute a third movement in a direction substantially perpendicular to the axis of rotation of the cutting drum. The grinder may be configured to execute the first movement in a direction away from the axis of rotation of the cutting drum and towards the cutting position at the mouth before executing the second movement in the second direction substantially opposite to the first direction. Preferably the grinder is moved out of contact of the knives before the return movement in the substantially opposite direction is executed. A grinder assembly with a variety of movement patterns and options provides a flexible and adaptable grinding process and enables the optimum amount of material to be removed from the knives.

Preferably, the grinder is configured to be brought into contact with a predetermined portion of the cutting edge of the at least one knife after a first time interval and then after substantially equal time intervals. This arrangement and grinding sequence is found to be particularly useful in obtaining an evenly ground surface at the cutting edge and along the cutting edge. Most preferably, the interval between grinding is constant at every point along the cutting edge.

Preferably, movement in the first direction substantially parallel to the axis of rotation of the cutting drum is at a first speed in the range from 0.3 meters per second to 1 meter per second and more preferably around 0.5 meters per second. Preferably, movement in the second direction substantially opposite to the first direction and substantially parallel to the axis of rotation of the cutting drum is at a second speed in the range from 0.03 meters per second to 0.1 meters per second, more preferably 0.06 meters per second.

The, or each knife, may be configured to be to be fed in a direction away from the axis of rotation of the cutting drum and towards the cutting position at the mouth, with this arrangement the knives are moved towards the cutting position and can advantageously make repeatable, reliable cuts at the material to be cut. There may be a plurality of knives, for example a number of knives in the range from 8 to 10.

The grinder may be configured to be rotated about an axis arranged substantially parallel to the axis of rotation of the cutting drum at the cutting position allowing the grinder ease of access to the knives to be ground and such that the cutting edge is arranged to lie on an imaginary cylindrical surface.

Preferably, the cutting apparatus comprises a control assembly configured to control the movement of the grinder in a direction substantially parallel to the axis of rotation of the cutting drum. More preferably, the cutting apparatus comprises a control assembly configured to control the movement of the grinder in a direction perpendicular to the axis of rotation of the cutting drum and configured to control the movement in a direction substantially parallel to the axis of rotation of the cutting drum, wherein the speed of movement the grinder in the first direction substantially parallel to the axis of rotation of the cutting drum is faster than the speed of movement of the grinder in the second direction substantially parallel to the axis of rotation of the cutting drum and substantially opposite to the first direction. By this arrangement efficient knife sharpening is possible with the cutting apparatus being offline for the minimum time possible, thus avoiding delays in the processing of the tobacco product.

According to a second aspect, the present invention provides a grinder assembly for removing material from the cutting edge of at least one knife of a cutting apparatus, said cutting apparatus comprising

- a mouth defined by a jaw assembly for delivering material to be cut to a cutting position at the said mouth;
- a cutting drum having;
  - at least one knife the, or each, said knife having a cutting edge,
- the said cutting drum having drive means therefor and being rotatable about an axis arranged substantially parallel to the mouth such that the cutting edge of said at least one knife is arranged substantially perpendicular to the material to be cut;
- the grinder assembly comprising a grinder unit having a grindstone and driver and controller means therefor, the grinder comprising a cylinder having a cylindrical surface comprising a substantially constant radius, the grinder being configured to be rotated about an axis arranged substantially parallel to the axis of rotation of the cutting drum and the grinder being configured to be brought into contact with the cutting edge with a first wherein
- the grinder assembly is configured to be brought into contact with the cutting edge with a first movement in a first direction substantially parallel to the axis of rotation of the said cutting drum and with a second movement in a second direction substantially opposite to the first direction and substantially parallel to the axis of rotation of the cutting drum, wherein the grinder is configured to execute the first movement in the first direction at a substantially uniform first speed and the second movement in the second direction at a substantially uniform second speed, wherein the first speed is different to the second speed.

This arrangement presents a flexible grinder assembly that can be adapted to remove material from knives of a variety of different cutting apparatus equipment.

According to a third aspect, the present invention provides a method of manufacture for cut tobacco, comprising the steps of:

- delivering the tobacco material to be cut to a cutting position at a mouth defined by a jaw assembly;
- rotating a cutting drum having a cutting edge about an axis arranged substantially parallel to the mouth such that the cutting edge is arranged substantially perpendicular to the material to be cut; and
- bringing a grinder into contact with the cutting edge with a first movement in a first direction substantially parallel to the axis of rotation of the cutting drum and with a second movement in a second direction substantially opposite to the first direction and substantially parallel to the axis of rotation of the cutting drum, wherein the grinder is configured to execute the first movement in the first direction at a substantially uniform first speed and the movement in the second direction at a substantially uniform second speed, wherein the first speed is different to the second speed, and thereby grinding the cutting edge.

According to a fourth aspect, the present invention provides a method of manufacture for cut lengths of tobacco, configured with the aforementioned cutting apparatus.

In the description of the preferred embodiment of the invention the following terms are used and are set out below.

A first longitudinal dimension and a second longitudinal dimension are described. A first longitudinal dimension is a dimension measured substantially along the axis of rotation of the cutting drum and hereinafter referred to also as length (of, for example, cut strands) and width (of, for example, cutting drum). The length of the cut strands of tobacco is therefore a measurement of the dimension of the strand substantially in the direction of the axis of rotation of the cutting drum. The width of the cutting drum is therefore a measurement of the dimension of the cutting drum substantially in the direction parallel to its axis of rotation, and the width of the mouth is therefore a measurement of the dimension of the mouth opening in a direction substantially parallel to the axis of rotation of the cutting drum.

By movement in a transverse direction we mean in a direction substantially parallel to the axis of rotation of the cutting drum and thus along a length dimension.

A second longitudinal dimension is a dimension measured substantially perpendicular to the axis of rotation of the cutting drum hereinafter referred to also as width or depth or thickness. The width or depth of a cut is therefore the dimension of a cut in the plane substantially perpendicular to the axis of rotation of the cutting drum. A movement in a plane substantially perpendicular to the axis of rotation of the cutting drum can therefore be towards or away from the cutting drum.

By movement in a radial direction we mean in a direction substantially perpendicular to the axis of rotation of the cutting drum. By profile we mean the cutting edge on a knife blade and impinging on a material to be cut, a profile, also known as P, may also be the shape of the ground surface produced at a knife tip by the action of a grinder.

The present invention will now be described in more detail, by way of example only, with reference to the accompanying drawings, in which.

Figure 1:
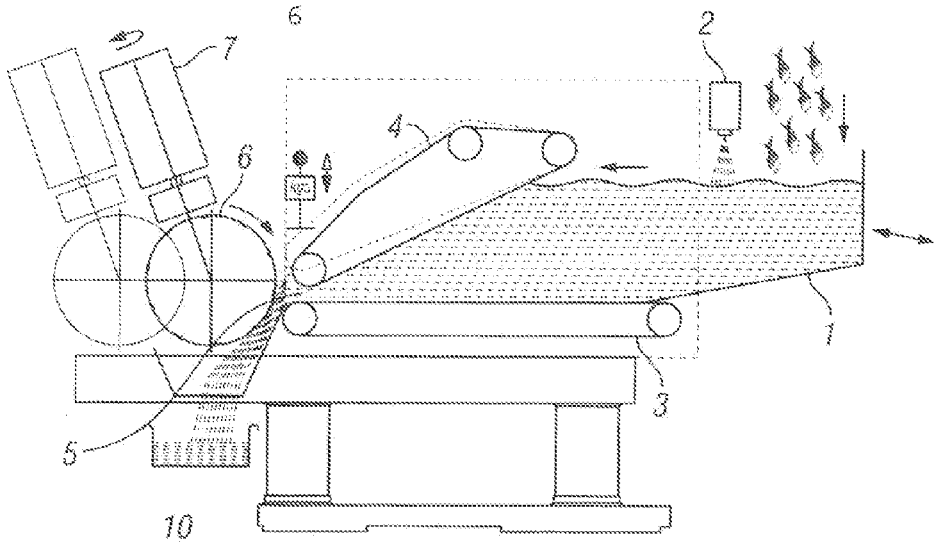
FIG. 1 (Prior Art)
FIG. 1 is a cross sectional view of a tobacco cutter of a conventional design suitable for adaptation to form the cutting apparatus and grinder assembly of the present invention.
Figure 2:
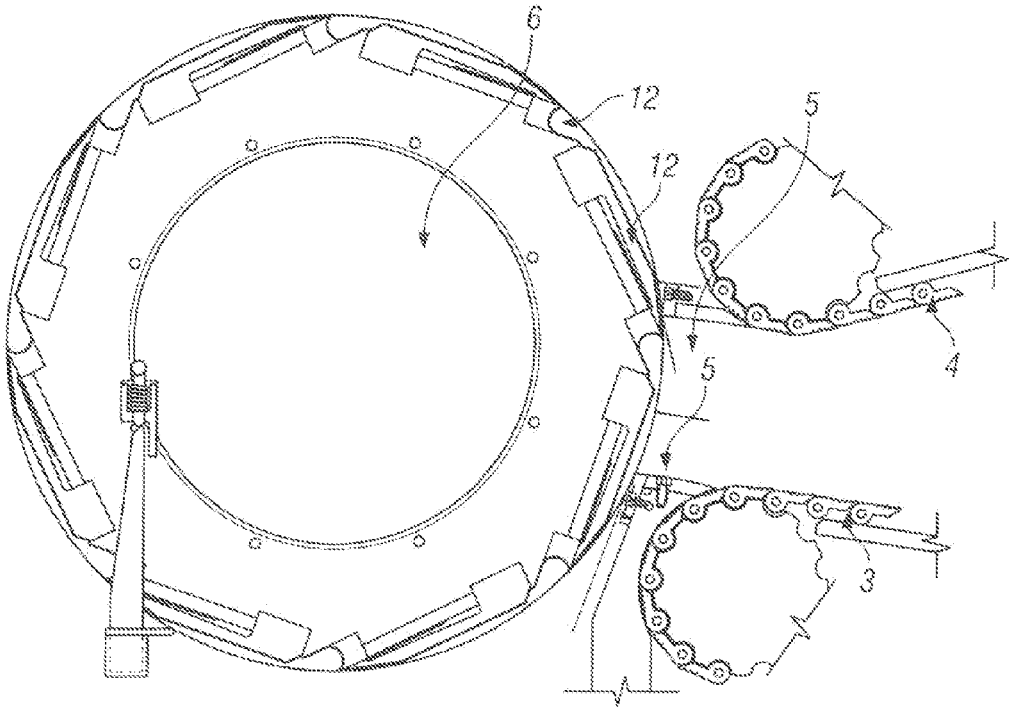
FIG. 2 (Prior Art)
FIG. 2 is a side view of the cutting drum of the tobacco cutter of FIG. 1, in further detail.
Figure 3:
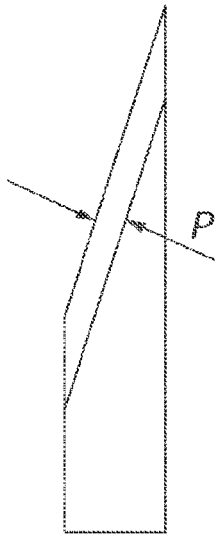
FIG. 3 is a side view of one of the knife tips of FIG. 2.

A type of conventional tobacco cutter and the cutter and grinder adapted to form the cutting apparatus of the present invention will now be described with reference to the apparatus of FIGS. 1, 2 and 3. Some details of the structure and operation of the cutting apparatus have been set out above and summary details are as follows. The cutting drum 6 can be fitted with knives 12 equally disposed around its circumference, between 8 and 10 knives can be used, although other numbers of knives 12 can be chosen. FIG. 2 shows the cutting drum in more detail. In the preferred embodiment the knives 12 are flat pieces of alloy steel approximately 1-1.5 mm thick, extending over the full width of the mouth 5.

The cutting drum 6 is supported between bearings and is driven by a motor (not shown) such that the drum rotates at a preferred speed of between 200 and 600 rpm.

The cutting drum 6 is located adjacent the mouth 5, through which a compressed 'cheese' or 'cake' of tobacco is extruded against the rotating cutting drum 6. The cutting drum 6 is positioned such that the axis of rotation of the cutting drum 6 is substantially parallel to the mouth 5. The action of the sharp knives 12 passing from top to bottom, from a location above the feed band 4 to a location below the feed band 3, of the extruded 'cheese' of laminar material to be cut results in strands of tobacco being cut whose thickness is a function of the speed of extrusion relative to the rotational speed of the cutting drum 6.

In a conventional arrangement of a tobacco cutter, the knives are fed outwards from a cutting drum by small amounts at frequent intervals, for example in increments of around 0.04 mm. A grinder in the form of a rotating grindstone 7 continually traverses across the width of the cutting drum 6, sharpening the knives and maintaining a sharp bevelled profile, P shown in FIG. 3, on the knives. The movement of the grindstone aims to achieve a radius of the knife tips from the mouth and from the centre of the cutting drum that remains constant. After a small number of traverses, the grindstone is fed radially, in other words in a radial direction, towards the axis of the cutting drum, and its contact position is kept constant by the action of a fixed diamond which 'dresses' the stone as it passes over it at one end of its stroke. The speed of conveyor belts or feed bands is controlled in a ratio to the speed of the drum so as to produce the required width of cut.

The purpose of the present invention is to optimise the sharpening of the knives. In the conventional method of grinding, the grinder unit traverses across the width of the cutting drum, stops and then traverses again in the opposite direction.

Figure 4:
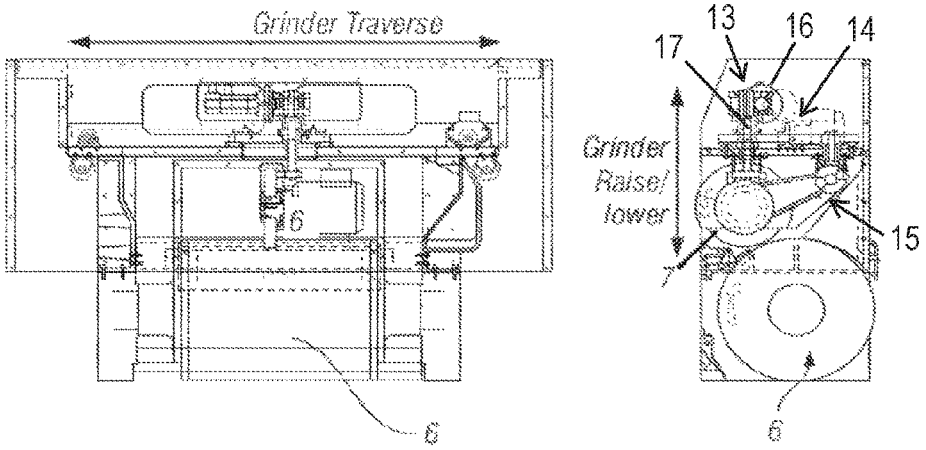
FIG. 4 is a front view and a corresponding side view of a portion of the cutting apparatus of the present invention showing a range of movement of the grinder.

The improvement to the operation of the conventional tobacco cutter of the present invention will now be described with reference to FIGS. 4, 5 and 6. In the preferred embodiment of the invention, the grinder takes the form of a grindstone wheel 7 mounted on an axis parallel to the axis of the cutting drum 6. The grinder comprises a cylinder having a cylindrical surface, or a plane surface, comprising a substantially constant radius. The grindstone assembly is arranged so that it can be accurately positioned closer to, or further away from, the periphery or outer circumference of the cutting drum 6. The grindstone 7 is driven by a motor and can be rotated. The grindstone is rotated at high speeds of up to around 3000 rpm. The grindstone 7 and its motor are carried on a pivoted arm 15. The pivoted arm, and thus the grindstone and motor are raised or lowered in the preferred embodiment by means of a geared stepper motor 16 and screw 17. The grindstone assembly is mounted on location apparatus for movement in the transverse direction, in a direction parallel to the axis of rotation of the cutting drum 6. In the preferred embodiment the location apparatus is a traversing trolley 13 supported by linear bearings 14 so that it can move across the width of the cutting drum 6.

The entire grindstone assembly is driven back and forth across the width of the machine by means of the separate traverse drive system, and the grindstone is accurately positioned relative to the knives on the cutting drum by a positioner, preferably using a stepper or servo motor. The position of the grindstone 7 may be determined by a lead-screw driven by a motor and provided with positioning apparatus such as a position encoder.

Figure 5:
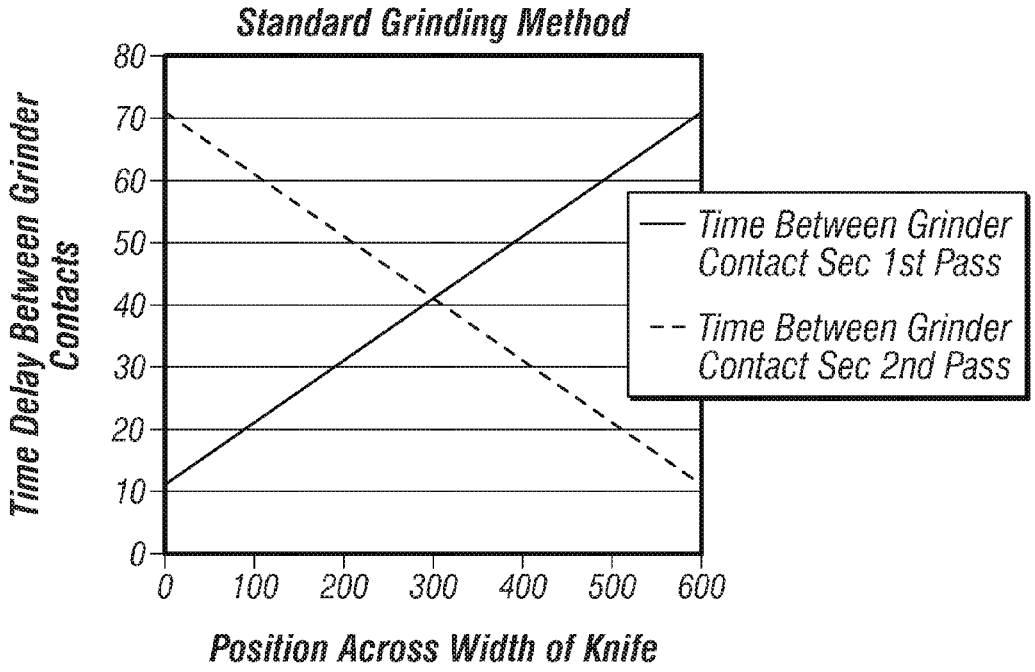
FIG. 5 is a graphical representation of contact grinding points across a knife in a conventional grinding method.

In FIG. 5, the conventional grinding pattern is recorded, this shows that at different positions across the drum width, the time interval between successive grinder contacts is variable, and can, for example, be as wide ranging as from 20 to 40 seconds. Thus, a portion of a knife, close to the outer portion of the blade will be sharpened and then, immediately upon reversal, when the return traverse has commenced, it will be sharpened again. This leads to a very short time interval between sharpenings for that portion of the knife blade. However, it can be seen from the illustration in FIG. 5 that on the reverse journey completion of the return traverse, leads to the time intervals between grinding to be a maximum. Using a transverse speed of 10 mm per second in both forward reversed directions and assuming a 1 second time delay upon reversal of the grinder direction, at a position 50 mm away from the end of the knife, where the width of the cutting drum and knives is 600 mm, the following typical time intervals can be found, there is a variation from say 5 seconds to 20-40 seconds in the intervals between grinding.

The disadvantage of this arrangement is that some portions of the knives receive sharpening after a very short time interval, whereas other portions are sharpened after a much longer time interval. To ensure that all portions of knife are always sufficiently sharp, then excessive sharpening has to be employed, resulting in more rapid usage of knife material, grindstone wear and wear of the diamond which is used to 'dress' the grindstone.

Figure 6:
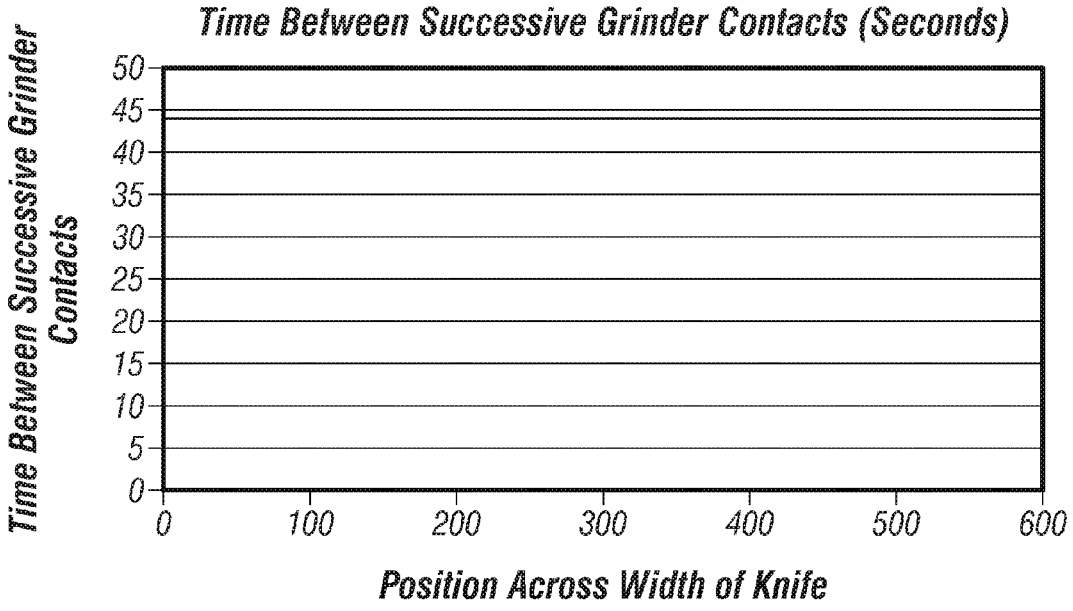
FIG. 6 is a graphical representation of contact grinding points across a knife using the apparatus and method of the present invention.

In contrast, in the embodiment of the present invention all portions of the knife across the width of the machine receive sharpening at the same successive time intervals, as illustrated in FIG. 6 with the following preferred operational parameters, the width of the cutting drum knives is 600 mm, and the grinder traverse speed is 20 mm per second in the forward (grinding) direction, and 50 mm per second in the reverse (returning, non-grinding) direction. The grinder is assumed to stop and reverse its traverse motion in 1 second. The reversal is assumed to take place 50 mm from the end of the knife at each end of the traverse.

The grinding apparatus of the preferred embodiment of the present invention includes a positioner to raise the grindstone out of contact with the knives immediately prior to the return traverse. The return traverse may then take place at a higher speed than the forward (grinding) traverse, since little or no grinding is taking place at this time. In the preferred embodiment the movement in the first direction, the forward transverse, is executed at a speed of around 0.06 meters per second and the movement in the second direction, the return traverse, is executed at a speed of around 0.5 meters per second. On completion of the return traverse, the grindstone is lowered by the positioned into the correct and optimum position for grinding the knives. The forward (grinding) transverse is then conducted across the width of the cutting drum at the slower speed of around 0.06 meters per second. With the technique of the preferred embodiment the time interval between grinder contact at successive portions or points across the width of the cutting drum with be the same, i.e. a ground point will be 're visited' and ground again at regular, pre determined time intervals.

In the two examples shown and illustrated in FIGS. 5 and 6, the mean time interval between successive points of grinder contact at the knives is approximately the same. However in the first example, illustrated in FIG. 5, only the central portion of the knife is ground under mean conditions, i.e. ground after the same time interval for both forward and return traverses of the grindstone over the knives. Indeed, the extreme ends are ground with very different time intervals between each grinding action, ranging from 10 to 70 seconds. In the second example, with rapid return grinding, the time interval between successive grinder contacts is constant for all positions across the cutting drum width.

In an alternative embodiment the width of the knives of the cutting drum is 410 mm, the speeds of forward and return traverse movements are the same as in the example above. The time interval between successive grinder contacts is constant for all positions across the cutting drum width, but the time taken to complete a traverse will be shorter.

Various modifications may be made to the described embodiment without departing from the scope of the present invention. There may be a different number of knives and grinders. There may be more than one cutting drum and more than one apparatus for delivery of the material to be cut, for example there could be more than one conveyor or compressing line. In an alternative embodiment the orientation of the axis of rotation or the configuration of the grinding wheel could be set at an angle or along a different axis to that of the cutting drum. Other arrangements can be envisaged for traversing the grinder back and forth across the width of the cutting drum, and to position the surface of the grindstone relative to the knives. In addition other speeds of rotation of the cutting drum and the grinder wheel can be envisaged, as well as other speeds for movement in the first and second directions along grinder wheel and knives.

The invention claimed is:

1. A cutting apparatus comprising, a mouth defined by a jaw assembly for delivering the material to be cut to a cutting position at the mouth;

a cutting drum having;

at least one knife having a cutting edge, the cutting drum having a driver therefor and being rotatable about an axis arranged substantially parallel to the mouth such that the cutting edge of the at least one knife is arranged substantially perpendicular to the material to be cut;

a grinder for removing material from the cutting edge of the at least one knife the grinder comprising a cylinder having a cylindrical surface comprising a substantially constant radius, the grinder being configured to be rotated about an axis arranged substantially parallel to the axis of rotation of the cutting drum and the grinder being configured to be brought into contact with the cutting edge with a first movement in a first direction substantially parallel to the axis of rotation of the cutting drum and with a second movement in a second direction substantially opposite to the first direction and substantially parallel to the axis of rotation of the cutting drum, wherein the grinder is configured to execute the first movement in the first direction at a substantially uniform first speed and the second movement in the second direction at a substantially uniform second speed, wherein the first speed is different to the second speed.

2. A cutting apparatus as claimed in claim 1, wherein the grinder is configured to execute a third movement in a direction substantially perpendicular to the axis of rotation of the cutting drum.

3. A cutting apparatus as claimed in claim 2, wherein the grinder is configured to execute the third movement in a direction away from the axis of rotation of the cutting drum and towards the cutting position at the mouth before executing the second movement in the second direction substantially opposite to the first direction.

4. A cutting apparatus as claimed in claim 1 wherein the grinder is configured to be brought into contact with a predetermined portion of the cutting edge of the at least one knife after a first time interval and then after substantially equal time intervals.

5. A cutting apparatus as claimed in claim 1, wherein the first speed is in the range from 0.3 meters per second to 1 meter per second.

6. A cutting apparatus as claimed in claim 1, wherein the second speed is in the range from 0.03 meters per second to 0.1 meters per second.

7. A cutting apparatus as claimed claim 1, wherein the knives are configured to be fed in a direction away from the axis of rotation of the cutting drum and towards the cutting position at the mouth.

8. A cutting apparatus as claimed in claim 1, wherein material is removed from the at least one knife such that the cutting surface of the at least one knife is ground and the cutting edge of the at least one knife is arranged to lie on an imaginary cylindrical surface that is concentric with the axis of rotation of the cutting drum.

9. A cutting apparatus as claimed in claim 1, further comprising a control assembly for controlling the movement of the grinder in a direction substantially parallel to the axis of rotation of the cutting drum.

10. A cutting apparatus as claimed in claim 9, wherein the control assembly is configured to control the movement of the grinder in a direction substantially perpendicular to the axis of rotation of the cutting drum and is configured to control the movement in a direction substantially parallel to the axis of rotation of the cutting drum, wherein the speed of movement of the grinder in the first direction substantially parallel to the axis of rotation of the cutting drum is faster than the speed of movement of the grinder in the second direction substantially parallel to the axis of rotation of the cutting drum and substantially opposite to the first direction.

11. A grinder assembly for removing material from the cutting edge of at least one knife of a cutting apparatus, said cutting apparatus comprising a mouth defined by a jaw assembly for delivering material to be cut to a cutting position at the said mouth;

a cutting drum having;

at least one knife, said knife having a cutting edge, the said cutting drum having a driver therefor and being rotatable about an axis arranged substantially parallel to the mouth such that the cutting edge of said at least one knife is arranged substantially perpendicular to the material to be cut;

the grinder assembly comprising a grinder unit having a grinder and the driver and a controller therefor, the grinder comprising a cylinder having a cylindrical surface comprising a substantially constant radius, the grinder being configured to be rotated about an axis arranged substantially parallel to the axis of rotation of the cutting drum, first wherein the grinder is configured to be brought into contact with the cutting edge with a first movement in a first direction substantially parallel to the axis of rotation of the said cutting drum and with a second movement in a second direction substantially opposite to the first direction and substantially parallel to the axis of rotation of the cutting drum, wherein the grinder is configured to execute the first movement in the first direction at a substantially uniform first speed and the second movement in the second direction at a substantially uniform second speed, wherein the first speed is different to the second speed.

12. A method of manufacture or cut lengths of tobacco, comprising the steps of:

delivering the tobacco material to be cut to a cutting position at a mouth defined by a jaw assembly;

rotating a cutting drum having a cutting edge about an axis arranged substantially parallel to the mouth such that the cutting edge is arranged substantially perpendicular to the material to be cut; and bringing a grinder into contact with the cutting edge with a first movement in a first direction substantially parallel to the axis of rotation of the cutting drum and with a second movement in a second direction substantially opposite to the first direction and substantially parallel to the axis of rotation of the cutting drum, wherein the grinder is configured to execute the first movement in the first direction at a substantially uniform first speed and the second movement in the second direction at a substantially uniform second speed, wherein the first speed is different to the second speed, and thereby grinding the cutting edge.

13. A method for controlling the operation of a cutting apparatus as claimed in claim 1 comprising a step of setting a time interval between successive contacts of the at least one knife with the grinder to be constant across the width of the at least one knife.

14. A method for controlling the operation of a cutting apparatus as claimed in claim 13, comprising a step of retracting the grinder out of contact with the at least one knife prior to traversing back to the grinder's starting position.

15. A method for controlling the operation of a cutting apparatus as claimed in claim 13 comprising a step of bringing the grinder back into contact with the at least one knife prior to making a traverse across the width of the cutting drum to grind and sharpen the at least one knife.

16. A method for controlling the operation of a cutting apparatus as claimed in claim 13, comprising a step of setting the traverse speed during the return traverse with the grinder out of contact with the at least one knife to be significantly faster than the forward traverse with the grinder in contact with the at least one knife.

* * * * *